US010801142B2

(12) United States Patent
Tseng

(10) Patent No.: US 10,801,142 B2
(45) Date of Patent: Oct. 13, 2020

(54) POSITIONING STRUCTURE FOR AN ECCENTRICALLY MOVABLE TONGUE SEAT

(71) Applicant: Hsien-Chang Tseng, Taichung (TW)

(72) Inventor: Hsien-Chang Tseng, Taichung (TW)

( * ) Notice: Subject to any disclaimer, the term of this patent is extended or adjusted under 35 U.S.C. 154(b) by 670 days.

(21) Appl. No.: 15/482,874

(22) Filed: Apr. 10, 2017

(65) Prior Publication Data

US 2018/0209082 A1 Jul. 26, 2018

(30) Foreign Application Priority Data

Jan. 26, 2017 (TW) ..... 106103136 A

(51) Int. Cl.

| | |
|---|---|
| ***D05B 27/08*** | (2006.01) |
| ***D05B 37/00*** | (2006.01) |
| ***D05B 81/00*** | (2006.01) |
| ***D05B 27/16*** | (2006.01) |

(52) U.S. Cl.

CPC ..... *D05B 27/08* (2013.01); *D05B 27/16* (2013.01); *D05B 37/00* (2013.01); *D05B 81/00* (2013.01)

(58) Field of Classification Search

CPC ..... D05B 37/00; D05B 37/04; D05B 27/08; D05B 27/16

USPC ..... 112/122, 318, 464

See application file for complete search history.

(56) References Cited

U.S. PATENT DOCUMENTS

| | | | | |
|---|---|---|---|---|
| 5,216,970 A * | 6/1993 | Sakuma | D05B 1/20 | 112/168 |
| 5,529,003 A * | 6/1996 | Kojima | D05B 37/04 | 112/168 |
| 7,367,274 B2 * | 5/2008 | Sadasue | D05B 1/20 | 112/122 |

FOREIGN PATENT DOCUMENTS

| | | |
|---|---|---|
| JP | 2003167272 A | 6/2003 |
| JP | 2005000401 A | 1/2005 |
| TW | I363822 B | 5/2012 |

* cited by examiner

*Primary Examiner* — Nathan E Durham

(74) *Attorney, Agent, or Firm* — Bruce Stone LLP; Joseph A. Bruce

(57) ABSTRACT

A positioning structure for a movable tongue seat includes: an eccentric positioning member disposed between the movable tongue seat and the cutter seat, the eccentric positioning member is provided with a rotary end which is located toward one end of the cutter seat, wherein the eccentric positioning member rotates about the rotary end and is further provided with a drive end which is inserted in a slot of the movable tongue seat, the drive end and the rotary end are not coaxially aligned; and a pivot hole and a pivot provided between the movable tongue seat and the cutter seat, so that the movable tongue seat is able rotate on the cutter seat by rotating about the pivot. When the eccentric positioning member rotates about the rotary end, the drive end can push the movable tongue seat to rotate about the pivot to a desired position.

6 Claims, 5 Drawing Sheets

POSITIONING STRUCTURE FOR AN ECCENTRICALLY MOVABLE TONGUE SEAT

BACKGROUND

Field of the Invention

The present invention relates to a positioning structure for a sewing machine, and more particularly to a positioning structure for an eccentrically movable tongue seat of a sewing machine.

Related Prior Art

A movable tongue seat of a cutter seat of a sewing machine is usually provided with a movable tongue, which is disclosed in Taiwan Patent No. I363822. Between the movable tongue seat and the movable tongue is provided an adjustment device in the form of a linear slide member, according to the disclosure of the Taiwan Patent No. I363822, when an adjustment rod of the adjustment device rotates, an eccentric cam disposed on the movable tongue (the linear slide member) will rotate, which consequently causes the rotation of a linkage, and the linkage will move approximately along the Y-axis direction due to the fact that the linkage has one end coupled to an eccentric area of the eccentric cam. At another end of the linkage, a swing cam of the movable tongue is pivotally disposed in an elongated slot and driven to rotate by a pin disposed in an above cavity, so that the swing cam can rotate about the shaft parallel to the X axis. The rotation of the swing cam of the movable tongue can cause the lateral displacement of the coupling protrusion formed around the annular surface of the swing cam along the X-axis direction, and another end of the movable tongue seat opposite to the end (of the movable tongue seat) fixed by the pin will swing approximately in the X-axis direction. The movement of the movable tongue seat requires two parallel cams and an eccentric to drive a linkage, the structure as a whole is complicated and involves motion conversion in multiple-axis directions, which can only be achieved by very high accuracy. After a period time of use, the parts of the whole structure might wear off and affect the fitting accuracy between the parts of the structure, and as a result, the movable tongue seat is unable to move the movable tongue to the desired position, and amendments are therefore necessary.

Taiwan Patent No. I363822 mentions a Japan Patent No. 2005-401 2003-167272, wherein the adjustment device for adjusting the position of the movable tongue includes the use of a micro-adjustment rod to rotate an eccentric cam and cause lateral displacement of a linkage. The pivot portion of the linkage is also caused to move laterally to cause movement of the end of the movable tongue, which consequently causes deviation of the movable tongue seat. However, the movement of the movable tongue lacks solid guidance. Besides, the movable tongue seat and the cutter seat interfere with each other. This structure is also complicated, and after a period time of use, the parts of the whole structure might wear off and affect the fitting accuracy between the parts of the structure, and as a result, the movable tongue seat is unable to move the movable tongue to the desired position, and amendments are therefore necessary.

The present invention has arisen to mitigate and/or obviate the afore-described disadvantages.

SUMMARY

One objective of the present invention is to provide a low cost and high driving efficiency positioning structure for an eccentrically movable tongue seat, wherein a stable adjustment can be achieved by a simple structural arrangement.

To achieve the above objective, the positioning structure of the movable tongue seat in accordance with the present invention comprises:

an eccentric positioning member disposed between the movable tongue seat and the cutter seat, the eccentric positioning member being provided with a rotary end which is located toward one end of the cutter seat, wherein the eccentric positioning member rotates about the rotary end and is further provided with a drive end which is inserted in a slot of the movable tongue seat, the drive end and the rotary end are not coaxially aligned; and a pivot hole and a pivot provided between the movable tongue seat and the cutter seat, so that the movable tongue seat is able rotate on the cutter seat by rotating about the pivot, when the eccentric positioning member rotates about the rotary end, the drive end can push the movable tongue seat to rotate about the pivot to a desired position.

The positioning structure of the movable tongue seat in accordance with another embodiment of the present invention comprises:

an eccentric positioning member disposed between the movable tongue seat and the cutter seat, the eccentric positioning member being provided with a rotary end which is located toward one end of the cutter seat, wherein the eccentric positioning member rotates about the rotary end and is further provided with a drive cavity, the movable tongue seat is provided with an inserting shaft to be inserted in and driven by the drive cavity, the inserting shaft and the rotary end are not coaxial to each other; and a pivot hole and a pivot provided between the movable tongue seat and the cutter seat, so that the movable tongue seat is able rotate on the cutter seat by rotating about the pivot, when the eccentric positioning member rotates about the rotary end, the drive cavity can push inserting shaft to move, so as to make the movable tongue seat rotate about the pivot to a desired position.

Preferably, a top surface of the cutter seat includes a first end surface and a second end surface which is higher than the first end surface, the pivot hole is located at the first end surface for insertion of the pivot which protrudes out of a bottom of the movable tongue seat, and a blade is provided at a lateral surface of the first end surface of the cutter seat.

Preferably, a pressing member is fixed to the cutter seat and includes a restricting top portion located on the top of the positioning portion and horizontally extending toward the movable tongue seat to restrict the movable tongue within the movable tongue seat, and an elastic portion horizontally extends from the pressing member and elastically presses against the eccentric positioning member to provide a damping effect.

Preferably, the eccentric positioning member is further provided with a damping portion which is located between the drive end and the rotary end, the rotary end is located at a center of the d damping portion, the elastic portion elastically presses against the damping portion to provide a damping effect, and a pulling portion extends from an edge of the damping portion.

Preferably, the movable tongue which includes a tongue end, a guide portion extending from the tongue end, and a pulling end perpendicular to the guide portion, the movable tongue seat includes a guide member in the form of a groove, and a gap formed in a lateral surface of the guide member, so that the guide portion is slidably received in the guide member, the pulling end extends out of the gap, and a lateral edge of the movable tongue seat cooperates with the pulling portion to restrict a rotation angle of the eccentric positioning member.

Preferably, a micro-adjustment seat is disposed at the second end surface of the cutter seat, the micro-adjustment seat is provided with an eccentric hole for insertion of the rotary end, and the stop portion is provided with a drive portion.

It is to be noted that the deviation of the movable tongue seat can be controlled simply by arranging the eccentric positioning member between the movable tongue seat and the cutter seat, and using the eccentric positioning member as an eccentric drive means, which requires no further extra structures, and therefore allows for easy assembly and low maintenance. Due to simple structure, the eccentric driving direction of the eccentric positioning member is opposite to the moving direction of the movable tongue seat, which allows the user to operate intuitively and quickly without mistake.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

The present invention will be clearer from the following description when viewed together with the accompanying drawings, which show, for purpose of illustrations only, the preferred embodiment in accordance with the present invention.

Figure 1:
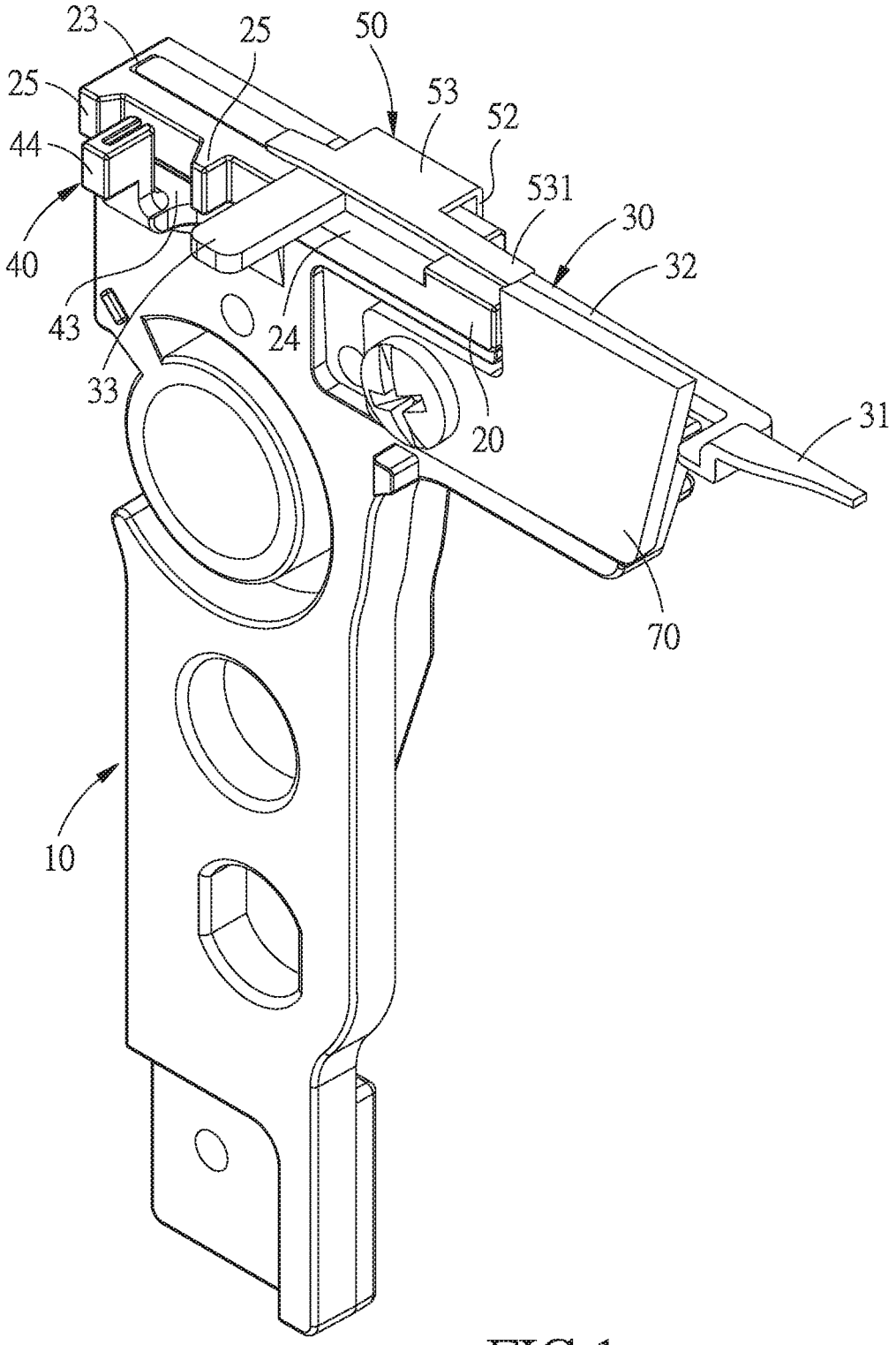
FIG. 1 is an assembly view of the positioning structure for the eccentrically movable tongue seat in accordance with a first embodiment of the present invention.
Figure 2:
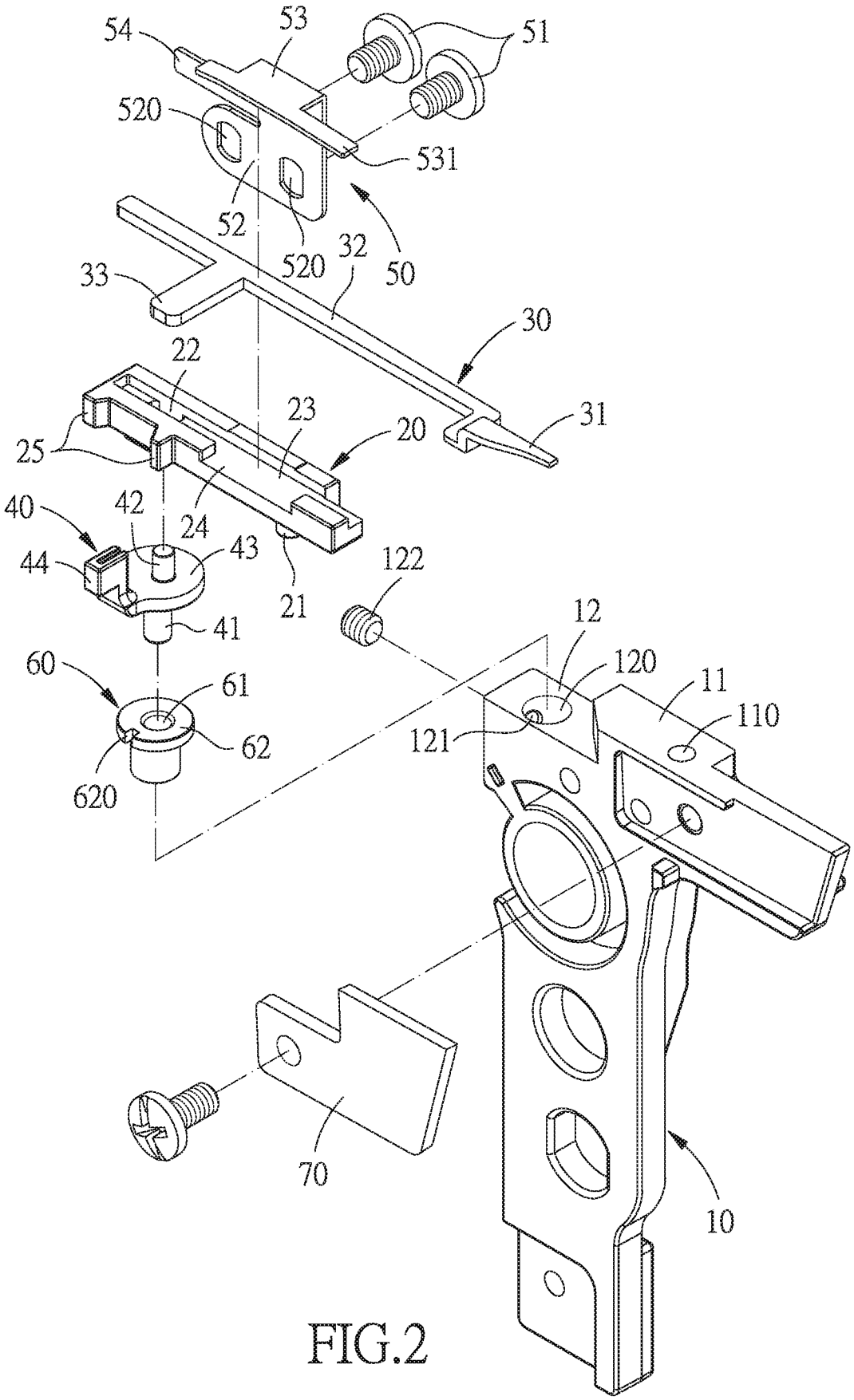
FIG. 2 is an exploded view of the positioning structure for the eccentrically movable tongue seat in accordance with the first embodiment of the present invention.
Figure 3:
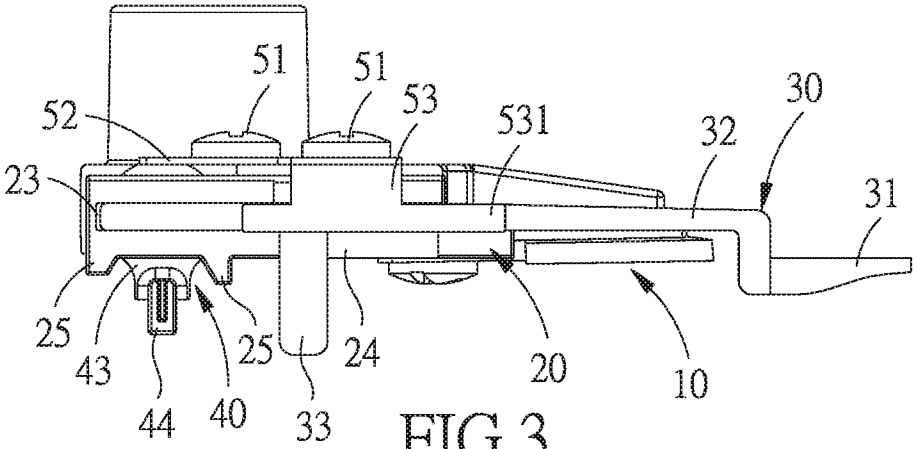
FIG. 3 is a top plan view of the present invention showing that the movable tongue is in its retracted position.

Referring to FIGS. 1-3, the positioning structure for the eccentrically movable tongue seat 20 in accordance with a first embodiment of the present invention is shown, wherein the movable tongue seat 20 is provided on a cutter seat 10 of a sewing machine, and on the movable tongue seat 20 is provided a movable tongue 30 which includes a tongue end 31, a guide portion 32 extending from the tongue end 31, and a pulling end 33 perpendicular to the guide portion 32. The movable tongue seat 20 includes a guide member 23 in the form of a groove, and a gap 24 formed in a lateral surface of the guide member 23, so that the guide portion 32 is slidably received in the guide member 23, and the pulling end 33 extends out of the gap 24.

The positioning structure of the movable tongue seat 20 comprises an eccentric positioning member 40 which is disposed between the movable tongue seat 20 and the cutter seat 10. The eccentric positioning member 40 is provided with a cylinder-shaped rotary end 41 which is located toward one end of the cutter seat 10. The eccentric positioning member 40 rotates about the rotary end 41 and is further provided with a cylinder-shaped drive end 42 which is inserted in a slot 22 of the movable tongue seat 20. The slot 22 has a width equal to a diameter of the drive end 42. The drive end 42 and the rotary end 41 are not coaxially aligned, so that, when the drive end 42 is eccentrically moved by the rotation of the eccentric positioning member 40, it will push the slot 22 to cause displacement of the movable tongue seat 20. The eccentric positioning member 40 is further provided with a disc-shaped damping portion 43 which is located between the drive end 42 and the rotary end 41 to facilitate the fixing of the angle of the eccentric positioning member 40 (the angle at which the eccentric positioning member 40 is located), and the rotary end 41 is located at the center of the disc-shaped damping portion 43. A pulling portion 44 extends from the edge of the damping portion 43.

A pivot hole 110 and a pivot 21 are provided between the movable tongue seat 20 and the cutter seat 10, in this embodiment, the pivot hole 110 is located in the cutter seat 10, and the pivot 21 is provided on the movable tongue seat 20, so that the movable tongue seat 20 can rotate on the cutter seat 10 by rotating about the pivot 21 which is inserted in the pivot hole 110. When the eccentric positioning member 40 rotates about the rotary end 41, the drive end 42 can push the movable tongue seat 20 to rotate about the pivot 21 to a desired position. The movable tongue seat 20 is provided at a lateral edge thereof with two protrusive restricting portions 25 which cooperate with the pulling portion 44 to restrict the rotation angle of the eccentric positioning member 40.

It can be learned from the drawings that a top surface of the cutter seat 10 includes a first end surface 11 and a second end surface 12 which is higher than the first end surface 11. The pivot hole 110 is located at the first end surface 11 for insertion of the pivot 21 which protrudes out of a bottom of the movable tongue seat 20. A blade 70 is provided at a lateral surface of the first end surface 11 of the cutter seat 10, and a pressing member 50 is provided at another opposite lateral surface of the first end surface 11 of the cutter seat 10. An adjustment hole 120 is provided at the second end surface 12, and a fixing hole 121 which is perpendicular to the adjustment hole 120 penetrates a lateral surface of the adjustment hole 120, so that a fixing bolt 122 is screwed through the adjustment hole 120 to fix the components disposed in the adjustment hole 120.

The pressing member 50 is fixed on the cutter seat 10, and in this embodiment shown in the drawings, the pressing member 50 is located at a lateral surface of the blade 70 and fixed to the cutter seat 10 by two bolts 51 inserting through a vertical end of the pressing member 50. The pressing member 50 is a flat piece which is bent into an L-shaped elastic structure. The vertical end of the pressing member 50 is provided with a positioning portion 52, and two through holes 520 are formed in the positioning portion 52 for insertion of the two bolts 51 through the cutter seat 10, so that the pressing member 50 is fixed to the cutter seat 10. The pressing member 50 includes a restricting top portion 53 located on the top of the positioning portion 52 and horizontally extending toward the movable tongue seat 20 to restrict the movable tongue 30 within the movable tongue seat 20. Both ends of the restricting top portion 53 are bent toward the movable tongue 30 to form a pressing end 531 to elastically press the movable tongue 30 into the movable tongue seat 20, which prevents disengagement of the movable tongue 30 from the movable tongue seat 20. An elastic portion 54 horizontally extends from the positioning portion 52 and elastically presses against the damping portion 43 of the eccentric positioning member 40 to provide a damping effect.

It is to be noted that a micro-adjustment seat 60 is disposed in the adjustment hole 120 of the second end surface 12 of the cutter seat 10 and can be fixed at a desired angle by the fixing bolt 122. The micro-adjustment seat 60 is provided with an eccentric hole 61, so that the eccentric positioning member 40 can have the rotary end 41 inserted into the eccentric hole 61 and rotate about the eccentric hole 61. The micro-adjustment seat 60 is provided with a stop portion 62 which stays outside the adjustment hole 120. The stop portion 62 is provided on a lateral edge thereof with a drive portion 620 in the form of a notch which is used to engage with and rotate a tool, so that the micro-adjustment seat 60 can be rotated to a desired angle to change the position of the eccentric hole 61, and as a result, the rotary end 41 of the eccentric positioning member 40 can be moved to a desired position, and thus the micro-adjustment of the eccentric positioning member 40 is finished.

Figure 4:
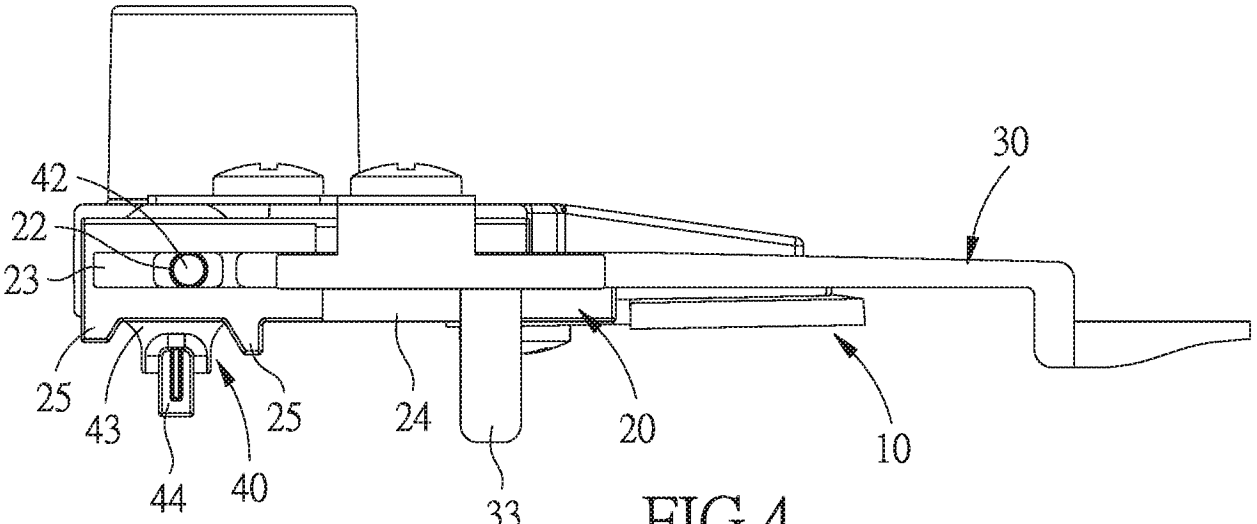
FIG. 4 is a top plan view of the present invention showing that the movable tongue is in its extended position.
Figure 5:
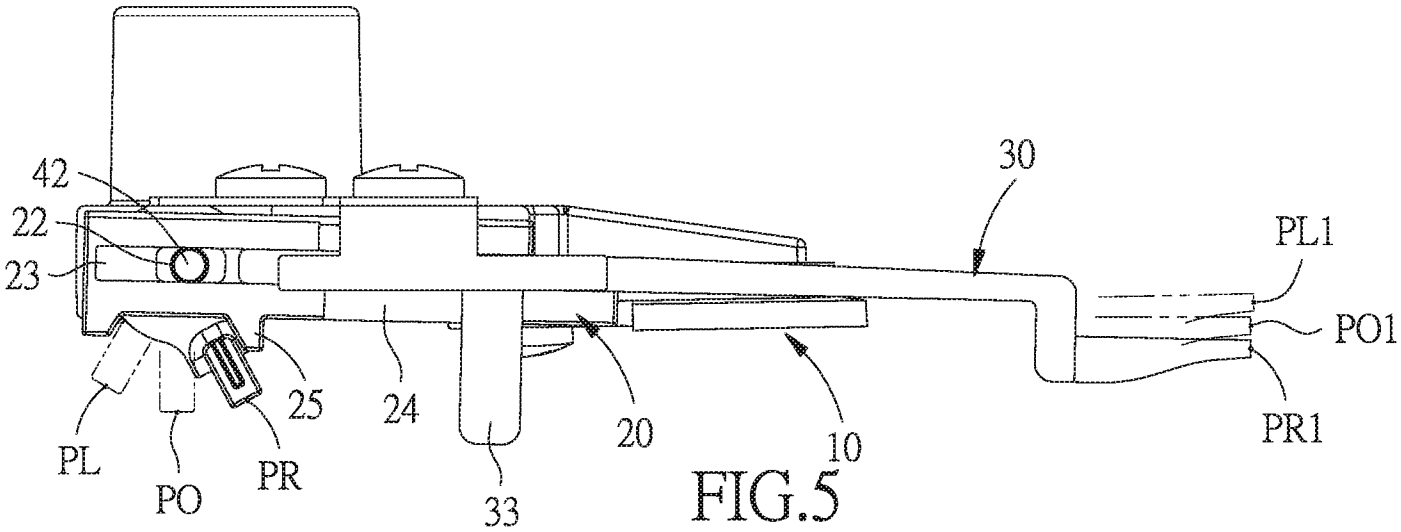
FIG. 5 is a top plan view of the present invention showing that the pulling end is in its retracted position.
Figure 6:
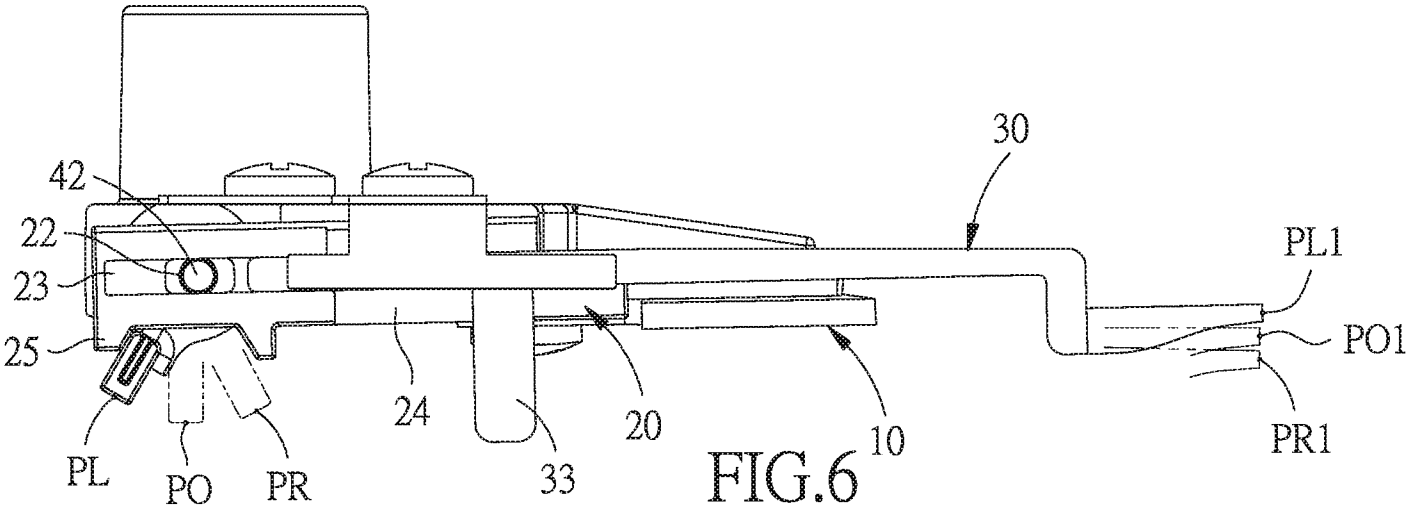
FIG. 6 is a top plan view of the present invention showing that the pulling end is in its extended position.

The operation of the movable tongue 30 is shown in FIGS. 3 and 4, pushing the pulling end 33 of the movable tongue 30 from an end point toward the start point of the gap 24 can push the movable tongue 30 into an extended position as shown in FIG. 4, and pushing it in a reverse direction can switch the movable tongue 30 to a retracted position as shown in FIG. 3. The operation of the present invention is shown in FIGS. 4 and 5, when in the extended position of the movable tongue 30, the positional deviation of the tongue end 31 occurs, the user can pull the pulling portion 44 to make adjustment, as shown in FIG. 4, the pulling portion 44 of the eccentric positioning member 40 is located in a position between the two protrusive restricting portions 25, and this position is defined as an original point PO, the position of the left one of the two protrusive restricting portions 25 is defined as a left point PL, and the position of the right one of the two protrusive restricting portions 25 is defined as a right point PR. The corresponding positions of the tongue end 31 to the positions PO, PL and PR of the pulling portion 44 are an original point PO1, a left point PL1 and a right point PR1. When positional deviation of the tongue end 31 of the movable tongue 30 occurs and needs to be adjusted toward the right point PR, as shown in FIG. 5, the user pulls the pulling portion 44 towards the right point PR, the drive end 42 eccentrically moves and pushes the lateral edge of the slot 22 to drive the movable tongue seat 20 to rotate around the pivot 21, and as a result, the tongue end 31 of the movable tongue 30 is moved to the right point PR1. When positional deviation of the tongue end 31 of the movable tongue 30 occurs and needs to be adjusted toward the left point PL, as shown in FIG. 6, the pulling portion 44 is pulled by the user toward the left point PL, and the tongue end 31 of the movable tongue 30 will move to the left point PL1. Therefore, the position and direction of the tongue end 31 can be intuitively perceivable and easily adjusted by pulling the pulling portion 44.

The structure of the present invention offers the following advantages:

1. simple structure: the deviation of the movable tongue seat 20 can be controlled simply by arranging the eccentric positioning member 40 between the movable tongue seat 20 and the cutter seat 10, and using the eccentric positioning member 40 as an eccentric drive means, which requires no further extra structures, and therefore allows for easy assembly and low maintenance.

2. efficient and direct drive: due to simple structure, the eccentric driving direction of the eccentric positioning member 40 is opposite to the moving direction of the movable tongue seat 20, which allows the user to operate intuitively and quickly without mistake.

Figure 7:
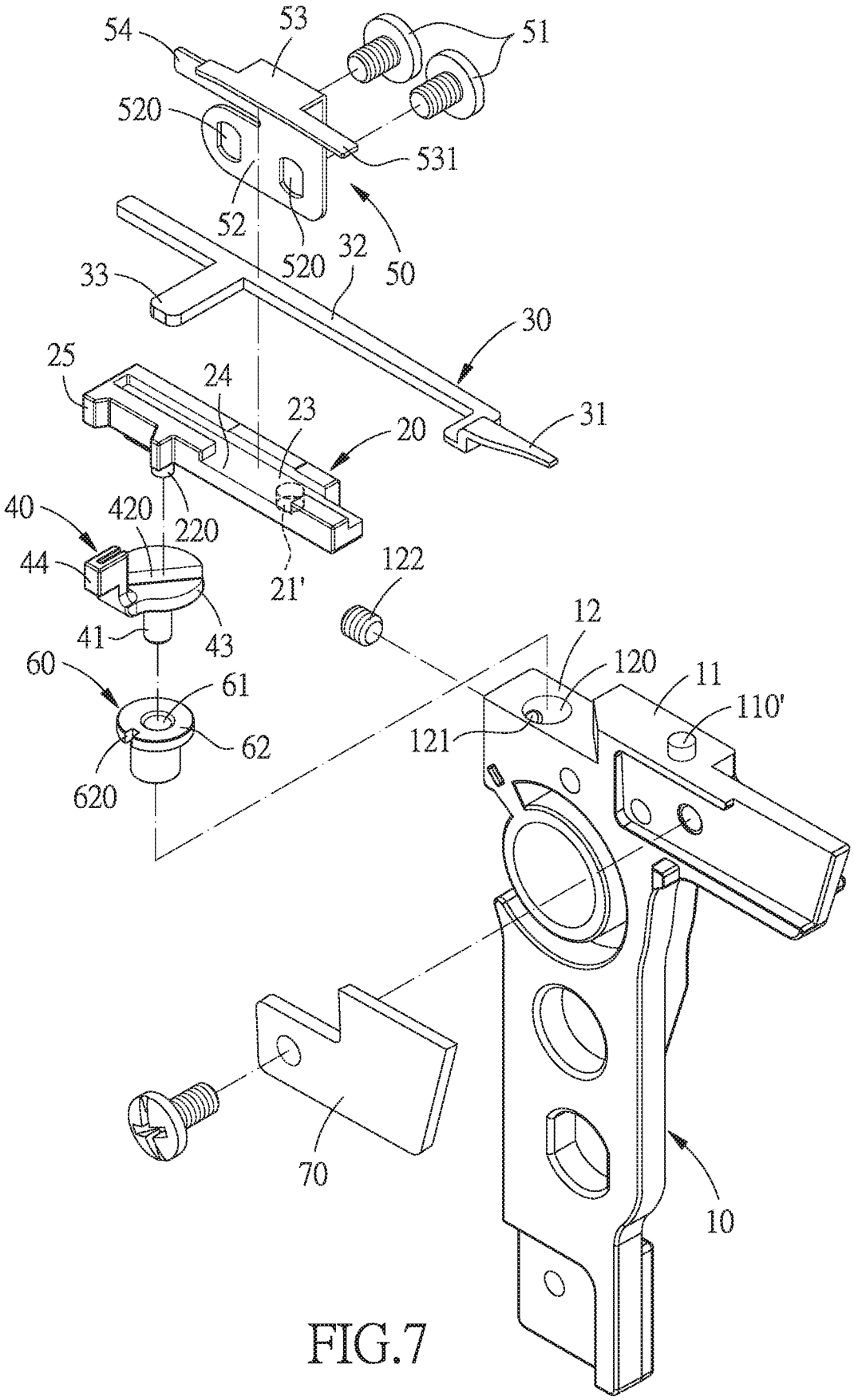
FIG. 7 is an exploded view of the positioning structure for the eccentrically movable tongue seat in accordance with a second embodiment of the present invention.

Referring to FIG. 7, another embodiment is shown, the arrangement of the eccentric positioning member 40 between the movable tongue seat 20 and the cutter seat 10 is similar to that of the previous embodiment, except that the damping portion 43 of the eccentric positioning member 40 is provided on a top surface thereof with a drive cavity 420, and the movable tongue seat 20 is provided with an inserting shaft 220 to be inserted in and driven by the drive cavity 420. The inserting shaft 220 and the rotary end 41 are not coaxial to each other, so that rotating the eccentric positioning member 40 can cause displacement of the movable tongue seat 20 via the inserting shaft 220, which can achieve the same function and effect as the previous embodiment. In this embodiment, a pivot hole 21' and a pivot 110' are provided between the movable tongue seat 20 and the cutter seat 10 and reverse positions as compared to the previous embodiment, namely, the pivot hole 21' is located at the bottom of the movable tongue seat 20, and the pivot 110' is located at the cutter seat 10.

While we have shown and described various embodiments in accordance with the present invention, it is clear to those skilled in the art that further embodiments may be made without departing from the scope of the present invention.

What is claimed is:

1. A positioning structure for an eccentrically movable tongue seat, wherein the tongue seat is provided on a cutter seat of a sewing machine, and a movable tongue is on the movable tongue seat; the positioning structure of the movable tongue seat comprising:

an eccentric positioning member disposed between the movable tongue seat and the cutter seat, the eccentric positioning member being provided with a rotary end which is located toward one end of the cutter seat, wherein the eccentric positioning member rotates about the rotary end and is further provided with a drive end which is inserted in a slot of the movable tongue seat, the drive end and the rotary end are not coaxially aligned; and the movable tongue seat includes a pivot, the cutter seat includes a pivot hole for insertion of the pivot of the movable tongue seat, so that the movable tongue seat is able rotate on the cutter seat by rotating about the pivot, when the eccentric positioning member rotates about the rotary end, the drive end can push the movable tongue seat to rotate about the pivot to a desired position.

2. The positioning structure as claimed in claim 1, wherein a top surface of the cutter seat includes a first end surface and a second end surface which is higher than the first end surface, the pivot hole is located at the first end surface for insertion of the pivot which protrudes out of a bottom of the movable tongue seat, and a blade is provided at a lateral surface of the first end surface of the cutter seat.

3. The positioning structure as claimed in claim 2, wherein a micro-adjustment seat is disposed at the second end surface of the cutter seat, the micro-adjustment seat is provided with an eccentric hole for insertion of the rotary end, the micro-adjustment seat is provided with a stop portion, and the stop portion is provided with a drive portion.

4. The positioning structure as claimed in claim 1, wherein a pressing member is fixed to the cutter seat and includes a restricting top portion horizontally extending toward the movable tongue seat to restrict the movable tongue within the movable tongue seat, and an elastic portion horizontally extends from the pressing member and elastically presses against the eccentric positioning member to provide a damping effect.

5. The positioning structure as claimed in claim 4, wherein the eccentric positioning member is further provided with a damping portion which is located between the drive end and the rotary end, the rotary end is located at a center of the damping portion, the elastic portion elastically presses against the damping portion to provide a damping effect, and a pulling portion extends from an edge of the damping portion.

6. The positioning structure as claimed in claim 5, wherein the movable tongue which includes a tongue end, a guide portion extending from the tongue end, and a pulling end perpendicular to the guide portion, the movable tongue seat includes a guide member in the form of a groove, and a gap formed in a lateral surface of the guide member, so that the guide portion is slidably received in the guide member, the pulling end extends out of the gap, and a lateral edge of the movable tongue seat cooperates with the pulling portion to restrict a rotation angle of the eccentric positioning member.

* * * * *